United States Patent [19]

Williamson

[11] Patent Number: 4,799,670

[45] Date of Patent: Jan. 24, 1989

[54] EXERCISE APPARATUS

[76] Inventor: Neil Williamson, 1814 E. Highway 14, Janesville, Wis. 53545

[21] Appl. No.: 60,821

[22] Filed: Jun. 12, 1987

[51] Int. Cl.[4] ..... A63B 21/00

[52] U.S. Cl. ..... 272/117; 272/134; 272/DIG. 4

[58] Field of Search ..... 272/117, 118, 123, 134, 272/143, DIG. 4

[56] References Cited

U.S. PATENT DOCUMENTS

| | | | |
|---|---|---|---|
| 684,688 | 10/1901 | Herz | 272/117 |
| 3,306,611 | 2/1967 | Gaul | 272/118 |
| 3,573,865 | 4/1971 | Annas | 272/117 |
| 4,253,662 | 3/1981 | Podolak | 272/123 |
| 4,319,747 | 8/1979 | Rogers | 272/73 |
| 4,407,495 | 9/1980 | Wilson | 272/117 |
| 4,494,751 | 1/1985 | Schnell | 272/117 |
| 4,598,907 | 8/1982 | Ross | 272/117 |
| 4,603,855 | 8/1986 | Sebelle | 272/134 X |
| 4,610,449 | 9/1986 | Diercks, Jr. | 272/118 |
| 4,621,810 | 11/1986 | Cummins | 272/134 |
| 4,627,614 | 12/1986 | De Angeli | 272/117 |
| 4,629,185 | 12/1986 | Amann | 272/134 X |
| 4,637,607 | 1/1987 | McArthur | 272/134 X |
| 4,721,303 | 1/1988 | Fitzpatrick | 272/117 |

FOREIGN PATENT DOCUMENTS

| | | | |
|---|---|---|---|
| 132162 | 1/1985 | European Pat. Off. | 272/118 |
| 2716281 | 10/1978 | Fed. Rep. of Germany | 272/117 |
| 635999 | 12/1978 | U.S.S.R. | 272/117 |
| 2170413 | 8/1986 | United Kingdom | 272/118 |

*Primary Examiner*—Richard J. Apley
*Assistant Examiner*—Robert D. Bahr
*Attorney, Agent, or Firm*—David J. Archer

[57] ABSTRACT

An apparatus is disclosed for exercising the arm muscles and upper torso muscles of a user. The apparatus includes a frame and a weighted arm is pivotally connected to the frame with the weighted arm being positioned such that the user is able to lift with the user's arms the weighted arm. A user operated release selectively changes the weight of the weighted arm such that in use of the apparatus when the user has repeatedly lifted the weighted arm a predetermined number of times, the user operates the release to change the weight to be lifted so that the optimum stress is applied to the muscles being exercised.

14 Claims, 4 Drawing Sheets

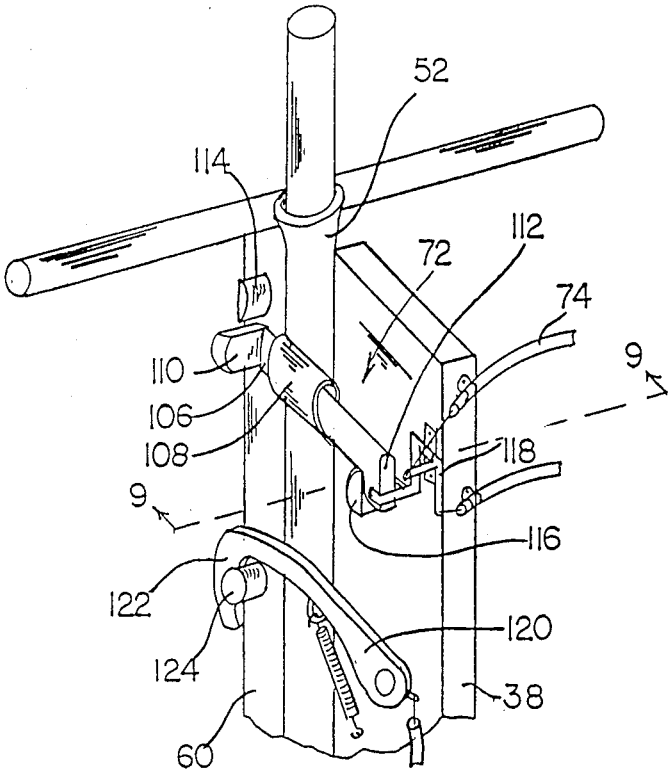
FIG. 2.
FIG. 3.
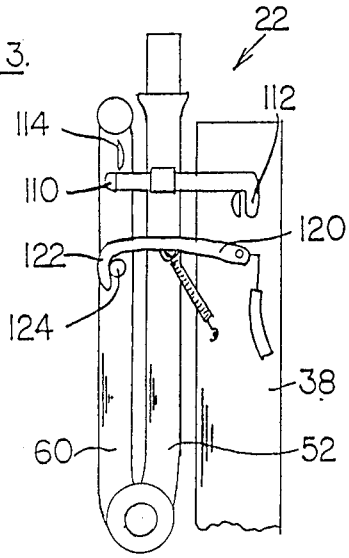
FIG. 4.
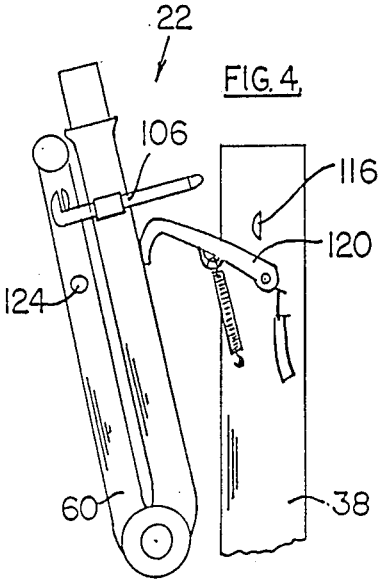

EXERCISE APPARATUS

BACKGROUND OF THE INVENTION

Field of the Invention

This invention relates to apparatus for exercising the arm muscles and upper torso muscles of a user. More specifically, this invention relates to an apparatus in which weights are lifted by the user and in which the weight can be selectively changed during the exercise.

In weight lifting, the weight lifter will over a period of time endeavour to gradually increase the amount of weights being lifted. This gradual increase in weight lifting capacity has the objective of increasing the size and effectiveness of the users muscles and the weight lifters physique.

Because of the desire on the part of the weight lifter to increase the weight lifting capacity, there exists a tendency on the part of the one exercising to endeavour to lift the weight a greater number of times than the user has ever lifted before. This can be especially difficult when dealing with heavy weights and low numbers of repetitions. For example, if the user has previously lifted 100 pounds four times and is striving to lift it five times, this feat could be very intimidating, causing the user to give up and stop at four repetitions.

The present invention seeks to overcome this problem by providing means by which the user or lifter can lift the 100 pounds four times and if the user is sure that this weight cannot be lifted a fifth time, can reduce the weight to 95 pounds and then lift this 95 pounds several times more.

Another objective of the present invention is to provide means to exercise the muscles when they are fully extended. As designed, the muscle being exercised is fully extended at the time that the weight is horizontal, then as the muscle is contracted, the weight reaches a perpendicular position and requires less stress from the muscle.

The aforementioned feature overcomes several disadvantages of the prior art proposals in which the exercise becomes harder towards the end of each repetition. Because of the exercise becoming harder, there exists a tendency on the part of the users of the prior art proposals to "swing" the weight rather than using the muscles and also to "cheat" by not lifting the weight the full cycle. The present invention is particularly advantageous when exercising the muscles of the back. The prior art does not provide means for accomplishing these objectives.

Another objective of the present invention is the elimination of the need for a "spotter" which is commonly necessary in use of the prior art proposals. A "spotter" is a helper or person who assists the lifter.

Another objective of the present invention is to give the lifter the means to lift, on the first repetition a lower weight and then switch to a higher weight on the second repetition. This option should result in a higher weight lifting capability because, in the prior art this first repetition at the same weight seems to shock the muscles and can be very intimidating to the lifter. The aforementioned "warm up" repetition at a lower weight therefor provides a useful feature of the present invention. Another object of the present invention is the virtually unlimited weight capability. In the prior art body building machines which usually work only one muscle, these machines contain a weight stack which could not be altered easily. Since each machine had to have its own weight stack, economics dictated that the amount of weight it contained be limited. This results in a situation in which the very proficient weight lifter outgrows the machine.

Another object of the present invention is to provide a truly multiple purpose facility with which the user can exercise every muscle of the upper body to the fullest extent.

Other objectives and advantages of the present invention will be readily apparent to those skilled in the art by a consideration of the following detailed description taken in conjunction with the annexed drawings which show the preferred embodiment of the present invention.

SUMMARY OF THE INVENTION

The present invention relates to an exercise apparatus for exercising the arm muscles and upper torso muscles of a user. The apparatus includes a frame and a weighted means are pivotally connected to the frame with the weighted means being positioned such that the user is permitted to lift with the user's arms the weighted means. A user operated release means is operated by the user for selectively changing the weight of the weighted means such that in use of the apparatus, when the user has repeatedly lifted the weighted means a predetermined number of times, the user operates the release means to change the weight to be lifted so that the muscles being execised receive the optimum stress.

More specifically, in a preferred embodiment of the present invention, the frame includes a base portion and an upwardly extending portion extending from the base portion for supporting a seat. The seat is adjustably secured to the frame for permitting the user to assume a seated position relative to the frame. An angularly adjustable back rest is secured to the upwardly extending portion and a support arm pivotally supports the weighted means, the support arm having a proximal and a distal end. The proximal end of the support arm is secured to the base portion and the distal end pivotally supports the weighted means such that the weighted means is able to pivot relative to the distal end.

The apparatus also includes a limiting rest which is rigidly secured to the base portion for supporting the weighted means in a first position thereof with the weighted means resting against on the limiting rest. The seat also includes a padded portion for enabling the user to be comfortably seated thereon and a seat support rigidly secured to the frame. A releasable means extends through the seat support for permitting the seat to be selectively adjusted relative to the frame. The seat also includes an opening for registration with a cooperating orifice defined by the upwardly extending portion. A locking pin extends through the registered opening and orifice for releasably securing the seat relative to the upwardly extending portion. The weighted means also includes a first arm pivotally secured to the frame, the first arm having a proximal and a distal end. A first loaded means is secured adjacent to the distal end of the first arm for pivoting the first arm away from the seat towards a first position thereof in which the user rests, the first loaded means being lifted by the user away from the first position such that the first arm pivots relative to the frame. A second arm is pivotally secured to the frame such that the first and second arms pivot about the same pivotal axis, the second arm having a proximal and a distal end. A second loaded means is secured adjacent to the distal end of the second arm such that the user is permitted to selectively lift one or both of the loaded means.

The release means includes a pedal operated by the foot of the user for releasing a portion of the weighted means such that when the user has repeatedly lifted the weighted means a predetermined number of times for exercising the arm muscles and upper torso muscles of the user, the user disconnects the portion of the weighted means by operation of the pedal so that a remaining portion of the weighted means is able to be lifted by the user for a further predetermined number of times to complete the exercise thereby providing optimum stress to the user's muscles. The pedal is operated by the foot of the user such that when the pedal is in a first position thereof, both arms are pivotted by the user and when in a second position only one of the arms is pivotted by the user. The release means further includes a latch pivotally secured to one of the arms and extending between the arms for selectively latching the arms together when the pedal is in the first position thereof and for unlatching the arms when the pedal is in the second position thereof, the latch being pivotally actuated by means of the pedal. The release means includes a push pull cable which extends between the pedal and the latch such that when the pedal is moved between the first and second positions thereof, the latch is moved from the latched to the unlatched disposition thereof.

The apparatus also includes lever means pivotally secured to the frame, the lever means cooperating with the user's arms such that movement of the arms of the user pivots the lever means relative to the frame. Transmission means extend between the lever means and the weighted means such that when the lever means pivots relative to the frame due to the exercising movement of the arms of the user, the weighted means is moved from a first position to a second disposition of the weighted means. The lever means more specifically includes a first lever having a first and a second end, the first lever being pivotally secured to the frame between the first and second end thereof for pivotal movement relative to the frame. A second lever has a first and a second end with the first end of the second lever drivingly cooperating with the first end of the first lever when the lever means is disposed in a first operating position thereof. The first end of the second lever drivingly cooperates with the second end of the first lever when the lever means is disposed in a second operating position thereof. A gear means is rotatably secured to the first lever and has the same rotational axis as the pivotal axis of the first lever, the gear means being driven by movement of the second lever when the second lever is connected to either the first or second end of the first lever. The lever means also includes a first chain and sprocket means for transmitting pivotal movement of the second lever to the gear means when the second lever is disposed in the first position thereof for exercising the user's upper torso muscles. A second chain and sprocket means transmits pivotal movement of the second lever to the gear means when the second lever is disposed in the second position thereof for exercising the user's biceps and triceps. The transmission means includes a gear box rigidly secured to the frame and a third chain and sprocket means drivingly extending between the gear box and the gear means such that movement of the second lever in either position thereof drives the gear box. A fourth chain and sprocket means drivingly extends between the gearbox and the weighted means such that movement of the second lever in either position thereof lifts the weighted means from the rested disposition thereof.

The gearbox is selectively reversible for permitting exercise by either outward or inward movement of the arms of the user.

The present invention is not limited to the preferred embodiment as described in the detailed description contained hereinafter or by the annexed drawings. Many variations and modifications will be readily apparent to those skilled in the art and these variations and modifications fall within the spirit and scope of the present invention as defined by the appended claims.

BRIEF DESCRIPTION OF THE DRAWINGS

FIG. 2 is an enlarged perspective view of the weighted means of the apparatus shown in FIG. 1.;

FIG. 3. is a side elevational view of the first and second arm of the weighted means as shown in FIG. 2. with the arms latched together;

FIG. 4. is a similar view to that shown in FIG. 3. but in a working position with both arms latched together;

DETAILED DESCRIPTION OF THE PREFERRED EMBODIMENT

Figure 1:
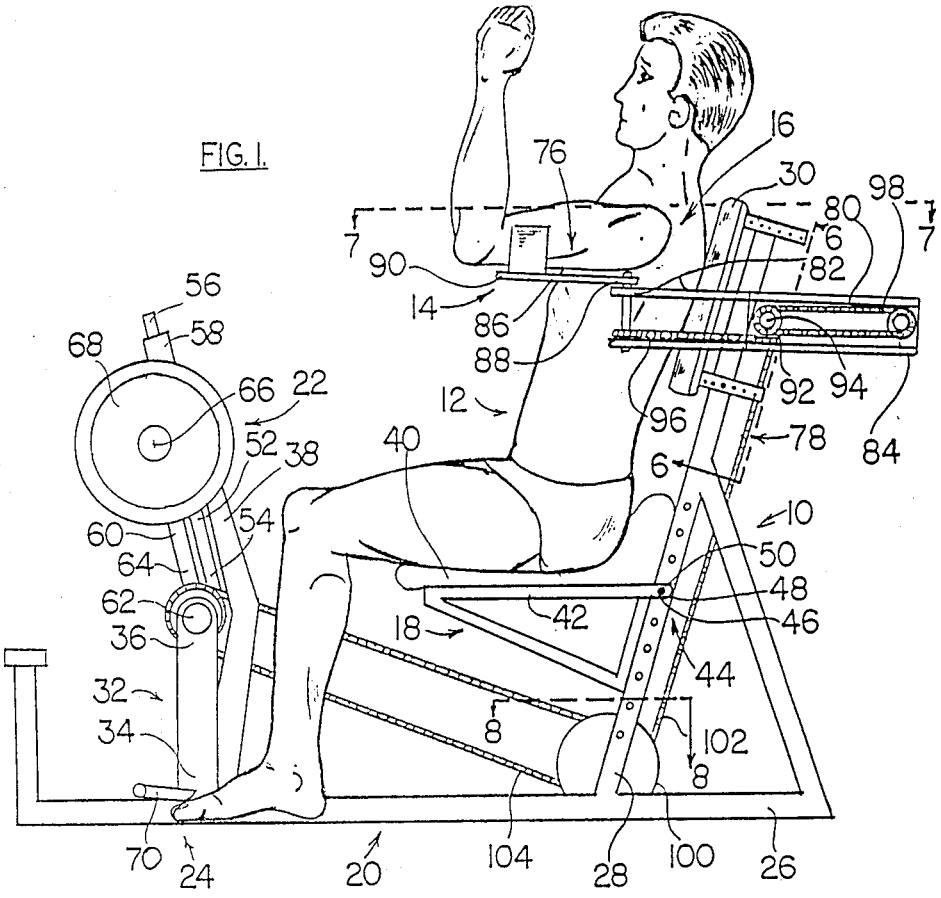
FIG. 1 is a side elevational view of the apparatus according to the present invention.

FIG. 1. is a side elevational view of the exercising apparatus generally designated 10 of the present invention. The apparatus 10 is used by a user generally designated 12 for exercising the user's arm muscles generally designated 14 and the muscles 16 of the upper torso. The apparatus 10 includes a seat 18 adjustably secured to a frame 20 for permitting the user 12 to assume a seated position relative to the frame 20 as shown in FIG. 1.

Weighted means generally designated 22 is pivotally connected to the frame 20 with the weighted means 22 being positioned such that the user 12 in a seated or standing position is permitted to lift with the user's arms the weighted means 22.

A user operated release means generally designated 24. allows the user 12 to selectively reduce the weight of the weighted means 22 such that in use of the apparatus 10, when the user 12 has repeatedly lifted the weighted means 22 a predetermined number of times, the user 12 operates the release means 24 to reduce the weight to be lifted so that the muscles 14, 16 being exercised receive optimum stress.

The frame 20 further includes a base portion 26 and an upwardly extending portion 28 which extends from the base portion 26 for supporting the seat 18. An angularly adjustable back rest 30 is secured to the upwardly extending portion for supporting the user's back. A support arm generally designated 32 for pivotally supporting the weighted means 22 has a proximal and a distal end 34 and 36 respectively. The proximal end 34 is secured to the base portion 26 and the distal end 36 pivotally supports the weighted means 22 such that the weighted means 22 is permitted to pivot relative to the distal end 36.

The frame 20 also includes a limiting rest 38 rigidly secured to the base portion 26 for supporting the weighted means 22 in a second position thereof as shown in FIGS. 2 and 3 with the weighted means 22 resting on or against the limiting rest 38.

As shown in FIG. 1, the seat generally designated 18 includes a padded portion 40 for enabling the user 12 to be comfortably seated thereon. A seat support 42 is rigidly secured to the padded portion 40 and secured to the frame 20. Releasable means 44 extend through the seat support 42 for permitting the seat 18 to be selectively adjusted relative to the frame 20. The seat support 42 defines an opening 46 for registration with a cooperating orifice 48 defined by the upwardly extending portion 28. The releasable means 44 includes a locking pin 50 which extends through the registered opening and orifice 46 and 48 respectively for releasably securing the seat 18 relative to the upwardly extending portion 28.

The weighted means 22 as shown in FIGS. 1–5 includes a first arm 52 pivotally secured to the frame 20. The first arm 52 has a proximal and a distal end 54 and 56 respectively. A first loaded means 58 such as drilled weights is secured adjacent to the distal end 56 of the first arm 52 for pivoting the first arm 52 away from the seat 18 towards a first position thereof as shown in FIG. 4 in which the user 12 rests. The first loaded means 58 is then lifted by the user 12 away from the first position such that the first arm 52 pivots relative to the frame 20.

A second arm 60 is pivotally secured to the frame 20 such that the first and second arms 52 and 60 respectively pivot about the same pivotal axis 62. The second arm 60 has a proximal and a distal end 64 and 66 respectively. A second loaded means 68 is secured adjacent to the distal end 66 of the second arm 60 such that the user 12 is permitted to selectively lift one or both of the loaded means 58, 68 respectively.

Figure 5:
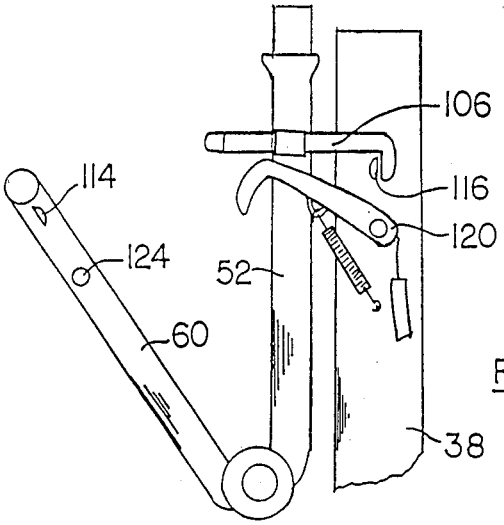
FIG. 5 is a similar view to that shown in FIG. 3 but with the arms unlatched enabling lifting of one loaded means only.

The user operated release means 24 includes as shown in FIG. 1 a pedal 70 operated by the foot of the user 12 for releasing a portion 68 of the weighted means 22 as shown in FIG. 5. When the user 12 has repeatedly lifted the weighted means 22 including loaded means 58 and 68 a predetermined number of times for exercising the user's muscles, the user 12 disconnects the portion 58 of the weighted means 22 by operation of the pedal 70 so that the remaining portion 68 of the weighted means 22 is able to be lifted by the user 12 for a further predetermined number of times to complete the exercise thereby obtaining optimum stress to the user's muscles. The pedal 70 is secured to the frame 20 such that when the pedal 70 is in a first position thereof, both arms 52 and 60 are pivotted by the user and when the pedal 70 is in a second position thereof only one of the arms that is the second arm 60 is pivotted by the user 12.

A latch 72 shown in FIGS. 2–5 is pivotally secured to the first arm 52 as shown in FIG. 5. As shown in FIG. 2 the latch extends between the arms 52 and 60 respectively for selectively latching the arms together when the pedal is in the first position thereof. When the pedal 70 is in the second position thereof, the arms 52 and 60 are unlatched relative to each other, the latch 72 being pivotally operated by the pedal 70.

A push pull cable 74 drivingly extends between the pedal 70 and the latch 72 such that when the pedal 70 is moved between the first and the second Position thereof, the latch 72 is moved from the latched to the unlatched disposition thereof.

Lever means generally designated 76 are pivotally secured to the frame 20. The lever means 76 cooperate with the user's arms such that movement of the users arms pivot the lever means 76 relative to the frame 20. Transmission means generally designated 78 extend between the lever means 76 and the weighted means 22 such that when the lever means 76 pivots relative to the frame 20 due to the exercising movement of the arms of the user, the weighted means is moved from a first position of the weighted means 22 to a second disposition of the weighted means.

The lever means 76 includes a first lever 80 having a first and a second end 82 and 84 respectively. The first lever 80 is pivotally secured to the frame 20 between the first and second ends thereof 82 and 84 for pivotal movement relative to the frame 20. A second lever 86 has a first and a second end 88 and 90 respectively. The first end 88 of the second lever 86 drivingly cooperates with the first end 82 of the first lever 80 when the lever means 76 is disposed in a first operating position thereof. Furthermore, the first end 88 of the second lever 86 drivingly cooperates with the second end 84 of the first lever 80 when the lever means 76 is disposed in a second operating position thereof. A gear means generally designated 92 is rotatably secured to the first lever 80 and has the same rotational axis 94 as the pivotal axis of the first lever 80. The gear means 92 is driven by movement of the second lever when the second lever 86 is connected to either the first end 82 of the first lever 80 or the second end 84 of the first lever 80.

The lever means 76 also includes a first chain and sprocket means 96 for transmitting pivotal movement of the second lever 86 to the gear means 92 when the second lever 86 is disposed in the first position thereof for exercising the user's upper torso muscles. A second chain and sprocket means 98 transmits pivotal movement of the second lever 86 to the gear means 92 when the second lever 86 is disposed in the second position thereof for exercising the user's biceps and triceps.

The transmission means 78 includes a gearbox 100 rigidly secured to the frame 20. A third chain and sprocket means 102 drivingly extends between the gearbox 100 and the gear means 92 such that movement of the second lever 86 in either position thereof drives the gearbox 100. A fourth chain and sprocket means 104 drivingly extends between the gearbox 100 and the weighted means 22 such that movement of the second lever 86 in either position thereof lifts the weighted means 22 from the rest disposition thereof.

The gearbox 100 is selectively reversible for permitting exercise by either outward or inward movement of the arms of the user.

More specifically, as shown in FIGS. 2–5, the weighted means 22 includes the latch generally designated 72. The latch 72 includes a bolt 106 rotatably secured within a sleeve 108 rigidly secured to the first arm 52. The bolt 106 has a first and a second head 110 and 112 respectively disposed at opposite ends of the bolt 106. The heads 110 and 112 extend radially relative to the longitudinal axis of the bolt 106 and are disposed at an angle of 90 degrees relative to each other. The head 110 cooperates with a stud 114 extending from the second arm 60 and the second head 112 cooperates with a second stud extending from the limiting rest 38 such that when the first stud 114 is latched with the first head 110, the second stud 116 is disengaged from the second head 112 and vice versa. A pivotal catch 118 pivotally secured to the limiting rest 38 moves from a first position as shown in FIG. 2 in which the catch 118 holds the head 112 in a second position shown in figure 4 in which the head 112 is released from engagement with the stud 116. The bolt is biased in a clockwise direction as viewed in FIG. 2 so that movement of the catch from the second to the first position thereof causes the bolt to rotate in a counterclockwise direction to assume the disposition shown in FIG. 2 with the arm 52 locked vertically against the rest 38.

In the second position as shown in FIG. 4, the arms 52 and 60 are locked together permitting the user to lift the entire weighted means of both arms.

A hook 122 is pivotally secured to the rest 38 and is releasably biased into engagement with a third stud 124 extending from the second arm 60 such that when the hook is engaged as shown in FIG. 3, the arms 52 and 60 are locked together against the rest 38. However, when the hook 120 is disengaged as shown in FIGS. 4 and 5, the arms 52 are disengaged as shown in to pivot away from the rest 38 as shown in FIG. 4 and the arm 60 only is permitted to pivot away from the rest 38 as shown in FIG. 5. Movement of the bolt 106 and the hook 120 is selectively controlled through push pull cables by operation of the pedal 70 or two pedals. In operation of the exercise apparatus, when the user wishes to exercise the arm and upper torso muscles, the user usually in a seated position will lift the second loaded means and in doing so will lift the loaded means 58. As shown in FIG. 4 both the first and second arms 52 and 60 will be locked together by the interaction of the stud 114 and head 110. In this first mode the user by means of the lever means 76 will lift the weighted means a predetermined number of times in order to exercise the muscles. Usually this predetermined number of times will represent the maximum number of times that the user is able to lift the combined loaded means 58 and 68 together. The user then by operation of the pedal 70 latches the first arm 52 to the limiting rest 38 as shown in FIG. 5.

Figure 9:
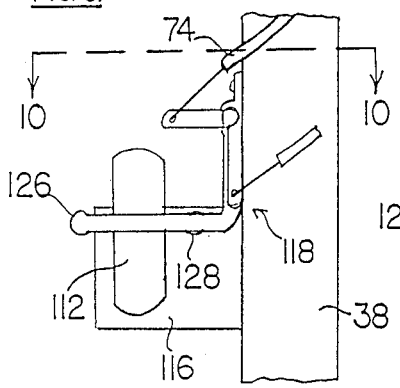
FIG. 9 is a sectional view taken on the line 9—9 of FIG. 2 showing the pivotal catch.

The user continues to lift the second loaded means 68 alone the first loaded means 58 being supported by the limiting rest 38. Thus the user continues to exercise by lifting the loaded means 68 alone a further predetermined number of times in order to achieve an optimal exercise of the user's muscles. When the user has completed the exercise, the arm 60 is pivoted to the upright position as shown in FIG. 3. and the locking member 120 is permitted to be biased counterclockwise to enable the hook 122 to engage the stud 124 thereby locking the weighted means 22 against movement. FIG. 9 is a sectional view taken on the line 9—9 of FIG. 2 and shows on an enlarged scale the pivotal latch 118 having a first and second extension 126 and 128 respectively which cooperate with the head 112 so that when the push pull cable 74 pivots the latch 118, the head 112 is pulled into engagement with the stud 116 or pushed out of engagement therewith.

Figure 10:
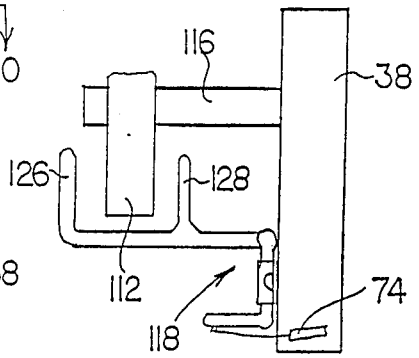
FIG. 10 is a sectional view taken on the line 10—10 of FIG. 9.

FIG. 10 is a sectional view on the line 10—10 of FIG. 9 and shows the disposition of the extentions 126 and 128 relative to the head 112.

Figure 6:
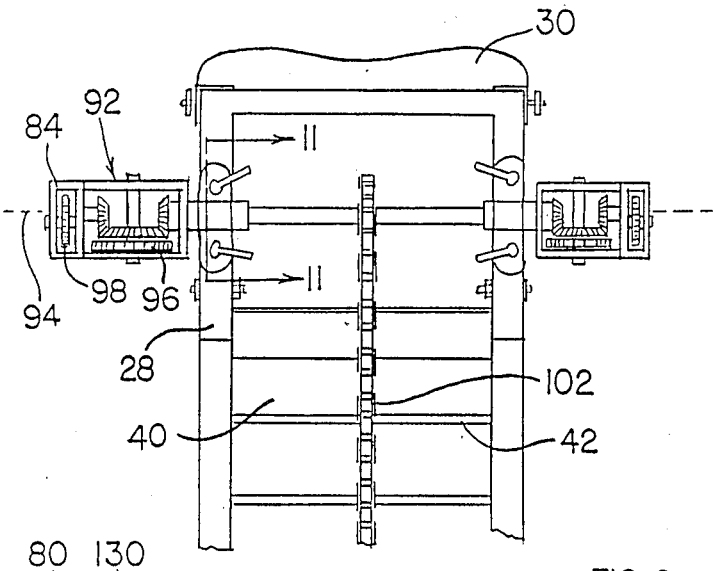
FIG. 6. is a partial sectional view taken on the line 6—6 of FIG. 1.
Figure 11:
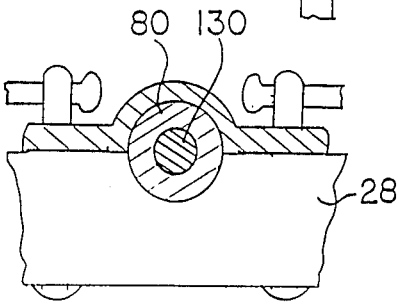
FIG. 11 is a sectional view taken on the line 11—11 of FIG. 6 showing the means for clamping the lever means to the frame.

FIG. 11 is a sectional view taken on the line 11—11 of FIG. 6 and shows the first lever 80 adjustably clamped relative to the portion 28. When the lever 80 is clamped against the portion 28 the central transmission rod 130 is rotatably supported within the lever 80.

Figure 7:
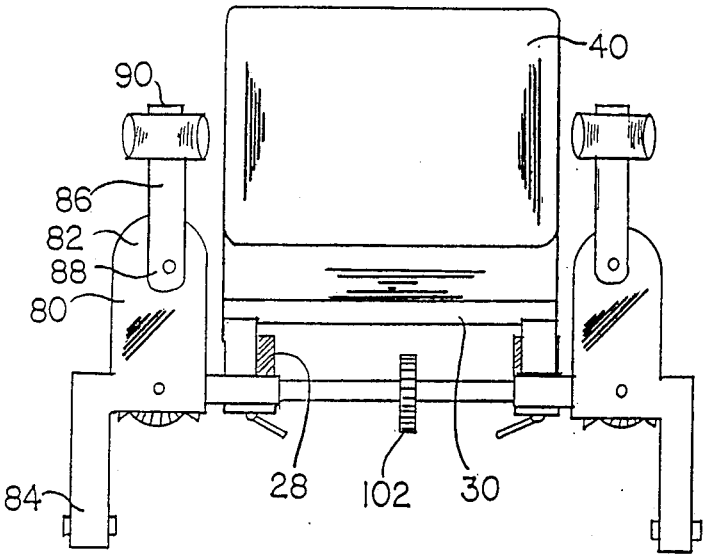
FIG. 7. is a sectional view taken on the line 7—7 of FIG. 1. showing the lever means.
Figure 8:
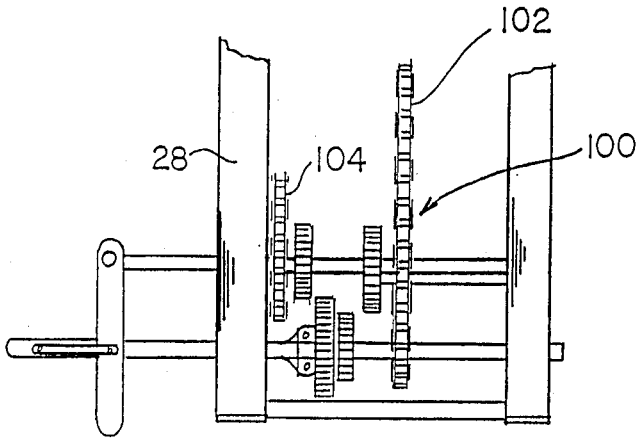
FIG. 8 is a sectional view taken on the line 8—8 of FIG. 1. showing the gearbox.

In the first mode of operation, by movement of the user's arms, the second lever arm 86 is moved outwardly as viewed in FIG. 1. This outward pivotal movement of arms 86 is transmitted by the first chain and sprocket means 96 so that the gear means 92 is rotated. Rotation of gear means 92 as shown particularly in FIG. 7 is transmitted by the third chain and sprocket means 102 to the gearbox 100. The gearbox 100 is connected by the fourth chain and sprocket means 104 so that the unlatched weighted means 22 are lifted by outward movement of the lever 86. Such movement in the first mode is particularly useful in building the user's back muscles.

In a second mode of operation, the first lever arm 80 is pivoted through 180 degrees as described hereinbefore and the second lever arm 86 is disengaged by removing the first end 88 thereof from the first end 82 of the arm 80. The first end 88 is then inserted into a socket of the second end 84 of the arm 80 so that the pivotal axis of the arm 86 in the second mode is disposed at an angle of 90 degrees relative to the pivotal axis of the arm 86 when in the first mode of operation. In the second mode, the user's arms are exercised by an upward or downward movement thereof as viewed in FIG. 1. This second mode of operation is particularly useful in developing the user's biceps or triceps. With the lever arm 86 connected to the second end 84 of the arm 80, movement upwardly or downwardly of the lever arm 86 causes rotation of the second chain and sprocket means 98. movement of the means 98 is transmitted through the gear means 92 so that the third chain and sprocket means is rotated. In the same manner as in the first mode of operation Movement of the arm 86 is transmitted to the weighted means 22 so that upward movement of the lever 86 causes the weighted means 22 in the unlatched condition to be lifted.

When the user brings the elbows together, the body parts exercised are pectorals. This is accomplished when the first lever 80 is horizontal. If the end 84 is elevated the shoulder muscles are exercised.

When the user pushes the elbows outwards, the body parts exercised are the back muscles, when the first lever is horizontal. If the end 84 is lowered, the upper back and shoulders are exercised. When the end 84 is raised, the upper back and laterals are exercised.

When the second lever is pushed upwards, the biceps are exercised. The seat must be raised so that the elbows are in line with the end 82 of the first lever 80. When the seat is lowered so that the shoulders are in line with the end 82 of the lever 80, the shoulders are exercised.

When the second lever 86 is pushed downwards, the triceps are exercised when the seat is raised so that the elbows are in line with the end 82.

When the seat is lowered, so that the shoulders are in line with the end 82, the laterals and shoulders are exercised.

It will be appreciated by those skilled in the art that the lever arm can be positioned relative to the frame 20 in a number of positions to variously provide the required degree of exercise. Also the gearbox 100 can be provided with gear ratios compatible with the weighted means such that the user is permitted to pivot the arm 86. Furthermore, the gearbox 100 has a manual control (not shown) enabling the gearbox to be reversed when operating in the second mode so that a variety of exercise movements are obtainable. Although in a preferred embodiment of the invention, the various modes are manually or pedal controlled, such controls may equally be by hydraulic, electrical, electronic or servo magnetic means. Additionally, although the weighted means is reduced in the preferred embodiment, the present invention includes increasing the weighted means during exercise by starting the exercise with movement of the second arm 60 alone and therafter increasing the weight by engaging the first arm 52 as shown in FIG. 4 Although the present invention has been described with reference to weighted arms, the present invention includes alternatively the replacement of the weighted means by a piston or by a cam making one weighted arm longer or shorter to vary the weight being lifted.

The present invention provides an exercise apparatus that is extremely versatile enabling the user thereof to engage in a great variety of exercises without having to change exercise apparatus. For this and other reasons the apparatus not only is very practical for use in health spas and gymnasiums but is also very suitable for installation in the user's own home.

I claim:

1. An exercise apparatus for exercising the arm muscles and upper torso muscles of a user, said apparatus comprising:

a frame;

weighted means pivotally connected to said frame, said weighted means being positioned such that the user is permitted to lift said weighted means with the user's arms;

said weighted means including:

a first arm pivotally secured to said frame, said first arm having a proximal and a distal end;

a first loaded means secured adjacent to said distal end of said first arm for pivoting said first arm towards a first position thereof in which the user rests, said first loaded means being lifted by the user away from said first position such that said first arm pivots relative to said frame;

a second arm pivotally secured to said frame such that said first and second arms pivot about the same pivotal axis, said second arm having a proximal and a distal end;

a second loaded means secured adjacent to said distal end of said second arm such that the user is permitted to selectively lift one or both of said loaded means; and user operated pedal release means for selectively changing the weight of said weighted means during use of the apparatus such that (in use of the apparatus), when the user has repeatedly lifted said weighted means a predetermined number of times, the user operates said release means to change the weight to be lifted so that the optimum stress is applied to the muscles being exercised.

2. An exercise apparatus as set forth in claim 1 wherein said frame further includes:

a base portion;

an upwardly extending portion extending from said base portion;

a seat adjustably secured to said frame for permitting the user to assume a seated position relative to said frame;

an angularly adjustable back rest secured to said upwardly extended portion;

a support arm for pivotally supporting said weighted means, said support arm having a proximal and a distal end, said proximal end being secured to said base portion, said distal end pivotally supporting said weighted means such that said weighted means is permitted to pivot relative to said distal end.

3. An apparatus as set forth in claim 2 wherein said frame further includes:

a limiting rest rigidly secured to said base portion for supporting said weighted means in a first position thereof with said weighted means resting on said limiting rest.

4. An apparatus as set forth in claim 2 wherein said seat further includes:

a padded portion for enabling the user to be seated comfortably thereon;

a seat support rigidly secured to said padded portion and secured to said frame;

releasable means extending through said seat support for permitting said seat to be selectively adjusted relative to said frame.

5. An apparatus as set forth in claim 2 wherein said seat further includes:

a seat support for securing said seat relative to said frame, said seat support defining an opening for registration with a cooperating orifice defined by said upwardly extending portion;

a locking pin extending through said registered opening and orifice for releasably securing said seat relative to said upwardly extending portion.

6. An apparatus as set forth in claim 1 wherein said release means further includes:

a pedal means operated by the user's foot for releasing a portion of said weighted means such that when the user has repeatedly lifted said weighted means a predetermined number of times for exercising the arm muscles and upper torso muscles of the user, the user disconnects said portion of said weighted means by operation of said pedal means so that a remaining portion of said weighted means is able to be lifted by the user for a further predetermined number of times to complete the exercise while providing optimum stress to the user's muscles.

7. An apparatus as set forth in claim 1 further including: lever means pivotally secured to said frame, said lever means cooperating with the users arms such that movement of the arms of the user pivots said lever means relative to said frame;

transmission means extending between said lever means and said weighted means such that when said lever means pivot relative to said frame due to the exercising movement of the arms of the user, said weighted means is moved from a first position of said weighted means to a second disposition of said weighted means.

8. An exercise apparatus for exercising the arm muscles and upper torso muscles of a user, said apparatus comprising:

a frame;

weighted means pivotally connected to said frame, said weighted means being positioned such that the user is permitted to lift with the users arms said weighted means;

user operated release means for selectively changing the weight of said weighted means such that in use of the apparatus, when the user has repeatedly lifted said weighted means a predetermined number of times, the user operates said release means to change the weight to be lifted so that the optimum stress is applied to the muscles being exercises;

said weighted means further including:

a first arm pivotally secured to said frame, said first arm having a proximal and a distal end;

a first loaded means secured adjacent to said distal end of said first arm for pivoting said first arm towards a first position thereof in which the user rests, said first loaded means being lifted by the user away from said first position such that said first arm pivots relative to said frame;

a second arm pivotally secured to said frame such that said first and second arms pivot about the same pivital axis, said second arm having a proximal and a distal end; a second loaded means secured adjacent to said distal end of said second arm such that the user is permitted to selectively lift one or both of said loaded means; and said release means further including:

a pedal secured to said frame for operation by the foot of the user such that when said pedal is in a first position thereof, both arms are pivotted by the user and when in a second position only one of said arms is pivotted by the user.

9. An apparatus as set forth in claim 8 wherein said release means further includes:

a latch pivotally secured to one of said arms and extending between said arms for selectively latching said first and second arms together when said pedal is in said first position thereof and for unlatching said arms when said pedal is in said second position thereof, said latch being pivotally actuated by means of said pedal.

10. An apparatus as set forth in claim 9 wherein said release means further includes:

a push pull cable extending between said pedal and said latch such that when said pedal is moved between said first and second positions thereof, said latch is moved from the latched to the unlatched disposition thereof.

11. An exercise apparatus for exercising the arm muscles and upper torso muscles of a user, said apparatus comprising:

a frame;

weighted means pivotally connected to said frame, said weighted means being positioned such that the user is permitted to lift with the users arms said weighted means;

user operated release means for selectively changing the weight of said weighted means such that in use of the apparatus, when the user has repeatedly lifted said weighted means a predetermined number of times, the user operates said release means to change the weight to be lifted so that the optimum stress is applied to the muscles being exercised;

lever means pivotally secured to said frame, said lever means cooperating with the users arms such that movement of the arms of the user pivots said lever means relative to said frame;

transmission means extending between said lever means and said weighted means such that when said lever means pivots relative to said frame due to the exercising movement of the arms of the user, said weighted means is moved from a first position of said weighted means to a second disposition of said weighted means;

said lever means further including:

a first lever having a first and a second end, said first lever being pivotally secured to said frame between said first and second end thereof for pivotal movement relative to said frame;

a second lever having a first and a second end, said first end of said second lever drivingly cooperating with said first end of said first lever when said lever means is disposed in a first operating position thereof, said first end of said second lever drivingly cooperating with said second end of said first lever when said lever means is disposed in a second operating position thereof; and a gear means rotatably secured to said first lever and having the same rotational axis as the pivotal axis of said first lever, said gear means being driven by movement of said second lever when said second lever is connected to either said first or second end of said first lever.

12. An apparatus as set forth in claim 11 wherein said lever means further includes:

a first chain and sprocket means for transmitting pivotal movement of said second lever to said gear means when said second lever is disposed in said first position thereof for exercising the users upper torso muscles;

a second chain and sprocket means for transmitting pivotal movement of said second lever to said gear means when said second lever is disposed in said second position thereof for exercising the users biceps.

13. An apparatus as set forth in claim 11 wherein said transmission means further includes:

a gear box rigidly secured to said frame;

a third chain and sprocket means drivingly extending between said gear box and said gear means such that movement of said second lever in either position thereof drives said gear box;

a fourth chain and sprocket means drivingly extending between said gearbox and said weighted means such that movement of said second lever in either position thereof lowers then lifts the weighted means from said rest disposition thereof.

14. An apparatus as set forth in claim 13 wherein said gearbox is selectively reversible for permitting exercise by either outward or inward movement of the arms of the user.

* * * * *